US010716336B2

(12) United States Patent
McCuaig

(10) Patent No.: US 10,716,336 B2
(45) Date of Patent: Jul. 21, 2020

(54) SPORTS SOCK

(71) Applicant: Ronald McCuaig, Dumbarton (GB)

(72) Inventor: Ronald McCuaig, Dumbarton (GB)

( * ) Notice: Subject to any disclaimer, the term of this patent is extended or adjusted under 35 U.S.C. 154(b) by 57 days.

(21) Appl. No.: 15/776,316

(22) PCT Filed: Nov. 21, 2016

(86) PCT No.: PCT/GB2016/053614
§ 371 (c)(1),
(2) Date: May 15, 2018

(87) PCT Pub. No.: WO2017/085514
PCT Pub. Date: May 26, 2017

(65) Prior Publication Data

US 2018/0317565 A1 Nov. 8, 2018

(30) Foreign Application Priority Data

Nov. 19, 2015 (GB) ..... 1520382.1
Mar. 22, 2016 (GB) ..... 1604840.7

(51) Int. Cl.
*A41B 11/00* (2006.01)
*A43B 13/22* (2006.01)

(52) U.S. Cl.
CPC ..... *A41B 11/007* (2013.01); *A41B 11/008* (2013.01); *A41B 2400/20* (2013.01); *A41B 2400/80* (2013.01)

(58) Field of Classification Search
CPC ... A41B 11/008; A41B 11/004; A41B 11/005; A41B 11/02; A41B 2400/80;
(Continued)

(56) References Cited

U.S. PATENT DOCUMENTS 2,075,229 A * 3/1937 Rose ..... A43B 5/08 36/62
2,179,124 A * 11/1939 Jesnig ..... A43B 5/08 36/8.1

(Continued)

FOREIGN PATENT DOCUMENTS

CN 201011856 Y 1/2008
CN 103653267 A 3/2014
WO WO-9824334 A2 6/1998

OTHER PUBLICATIONS

International Search Report and Written Opinion dated Jan. 25, 2017 for PCT Application No. PCT/GB2016/053614.

(Continued)

*Primary Examiner* — Robert H Muromoto, Jr.
(74) *Attorney, Agent, or Firm* — Moser Taboada

(57) ABSTRACT

A method of forming a flexible pad and a sock comprising at least one flexible pad located on the underside of the sock is disclosed. The at least one flexible pad has a rear face attached to the sock, and an outwardly facing front face. A plurality of suckers are located on the at least one flexible pad section, and on the front face of the at least one flexible pad section, and each of the plurality of suckers form a concave shape. Each of the plurality of suckers are capable of creating a suction action when depressed from the rear face under pressure, and each of the plurality of suckers has a circular shaped side wall. An outer surface of the side wall is sloped inwards towards a central part of the sucker, and the base of the side wall is wider than the top portion.

20 Claims, 18 Drawing Sheets

(58) Field of Classification Search
CPC ..... A41B 2400/82; A43B 5/08; A43B 13/223; A43B 7/146; A41D 13/0015; A41D 19/01523; A41D 19/01558; A41D 19/01547; A41D 2400/80; A41D 2400/82
See application file for complete search history.

(56) References Cited

U.S. PATENT DOCUMENTS 2,541,738 A * 2/1951 Bassichis ..... A43B 5/08 36/8.1
3,676,940 A * 7/1972 Shively ..... A43B 5/08 36/8.1
4,322,894 A * 4/1982 Dykes ..... A43B 5/08 36/114
7,346,935 B1 * 3/2008 Patterson ..... A41B 11/004 2/239
10,076,436 B2 * 9/2018 Jones ..... A61F 5/0111
10,104,924 B2 * 10/2018 Dassler ..... A41D 19/01523
2002/0000003 A1 * 1/2002 Boersema ..... A41B 11/008 2/239
2004/0221371 A1 * 11/2004 Kato ..... A41B 11/008 2/239
2005/0091725 A1 * 5/2005 Alley ..... A41B 11/004 2/139
2005/0091729 A1 * 5/2005 Alley ..... A41B 11/004 2/239
2005/0144703 A1 * 7/2005 Hilbert ..... A41B 11/008 2/239
2006/0026740 A1 * 2/2006 Vargas ..... A41B 11/02 2/239
2014/0223630 A1 * 8/2014 Johnson ..... A41D 19/01547 2/69

OTHER PUBLICATIONS

Chinese Search Report dated Jun. 3, 2019, for Application No. 2016800663666.

* cited by examiner

Suction cups integrated into pad surface.

SPORTS SOCK

FIELD OF THE INVENTION

The present invention relates to an improved type of sock mainly for use during sporting activities. In particular, the present invention relates to socks which have improved grip and/or airflow during use.

BACKGROUND OF THE INVENTION

Many sports such as racket sports including tennis, squash, table tennis and badminton and other types of sports such as golf, baseball, soccer, American football and basketball require a player to have good balance and grip which effects the outcome of shots and playing performance. Moreover, other sports which involve any amount of running such as runners, long jumpers, javelin throwers, sprinters and footballers require a user to have good grip during activities which sometimes require sudden changes in direction and/or speed.

It is therefore an object to provide a sock for sports users which has improved grip in their footwear during use.

It is a further object of the present invention to provide a sock with improved ventilation thereby preventing a user's feet and lower legs from overheating and becoming saturated in sweat.

SUMMARY OF THE INVENTION

According to a first aspect of the present invention there is provided a sock comprising:

at least one pad section located on the underside of the sock; and wherein the at least one pad comprises a plurality of suckers.

According to a second aspect of the present invention there is provided a sock comprising:

at least one flexible pad section located on the underside of the sock;

the at least one flexible pad section having a rear face which is attached to the sock and an outwardly facing front face;

a plurality of suckers located on the at least one pad section;

on the front face of the at least one flexible pad section the suckers form a concave shape and are therefore capable of creating a suction action when depressed under pressure; and wherein the plurality of suckers thereby are able to more securely attach a person's foot to the inside of a shoe during use.

The present invention therefore relates to a sock where there are suckers on the underside of the sock which are designed to increase traction and securely connect an athlete to their shoes and prevent any slippage occurring. This is extremely important in sprinting or other sports where sudden forces are exerted such as runners, long jumpers, javelin throwers, sprinters and footballers. This is also relevant for racket sports including tennis, squash, table tennis and badminton and other types of sports such as golf, baseball, soccer, American football and basketball.

On the underside of the sock there may in addition be a base rubber, rubber-like and/or plastics membrane located on the bottom of the sock which extends from the toe area to the heel area. The base rubber, rubber-like and/or plastics membrane may cover the majority or all of the outer sole of the sock.

The base rubber, rubber-like and/or plastics membrane may be flexible and resiliently deformable.

The base rubber, rubber-like and/or plastics membrane may comprise a front foot portion, a rear foot portion (i.e. a heel portion) and a thin linking portion. The base rubber, rubber-like and/or plastics membrane is only an optional feature of the sock and can be used where additional grip is required. The flexible pads may be attached on top of this base membrane.

The base rubber, rubber-like and/or plastics membrane may be flat or may comprise a series of thin parallel rubber, rubber-like and/or plastics material strips in the form of small ridges running the length of the sole of the sock i.e. from the toe area to the heel area.

The parallel strips of rubber, rubber-like or plastics material strips are able to expand and contract during use i.e. stretch and expand. It has been found that it is preferred that the rubber, rubber-like and/or plastics material strips are aligned to run parallel to the full length of the sole of the sock.

The parallel strips of rubber, rubber-like and/or plastics based material may therefore be placed along the full length of the sock or may simply be at a front and/or heel portion of the sock.

On the sole of the sock there may be a front rubber, rubber-like and/or plastics based pad section. There may be about 2-50 suckers on this front pad section or about 10-30. The suckers may be located substantially evenly over the front pad section. The suckers may be of all the same size and shape or there may be a variety of shapes and sizes.

The pad sections in all embodiments of the present invention may be adhered to a sock using any form of adhesive process e.g. glue and/or fastened on such as using a stitching method. The pad sections may therefore be directly attached to the sock.

In alternative embodiments the pad sections may be placed in to holes formed in the sock to receive the pad sections. The pad sections may then be adhered to a sock using any form of adhesive process e.g. glue and/or fastened on such as using a stitching method.

At the heel of the sock, there may be a second rubber, rubber-like and/or plastics based pad section. There may be about 2-50 suckers on this heel pad section or about 10-30. The suckers may be located substantially evenly over the heel pad section. The suckers may be of all the same size and shape or there may be a variety of shapes and sizes.

Both of the front and heel pad sections may be made from a thin portion of flexible rubber, rubber-like and/or plastics material. The front and heel pads may be flexible and resiliently deformable under pressure.

The pad sections may have a plurality of suckers integrated into the pad sections. The suckers are flexible and resiliently deformable under pressure.

The pad sections may be attached directly to the sock or may be attached to the base rubber, rubber-like and/or plastics membrane located on the bottom of the sock which extends from the toe area to the heel area.

The suckers are preferably but not exclusively made from the same material as the material forming the front and heel pad sections. The suckers may therefore be formed in a unitary manner with the pad sections.

It should be appreciated that any form and pattern of suckers may be used and for different sports they may be different preferred orientations and/or sizes of suckers.

At the heel portion of the sock, the rear portion of the base rubber, rubber-like and/or plastics membrane may extend around the heel and up part of the back of the achilles area of the leg. This has been found to provide further improved grip for user when the sock is in a shoe.

At the front foot portion the base rubber, rubber-like and/or plastics membrane may extend partially up and around the toe area of the sock. This has been found to provide further improved grip for user when the sock is in a shoe.

The suckers as defined in the present invention may be located on one or a plurality of protruding raised island-like areas on the front and heel pad sections. The raised island-like areas may also be compressed to provide additional comfort and grip for the user.

Between the island areas on the front and heel pad sections there may be channels which not only provide additional flexibility but also additional areas to create suction and gripping.

The channels may have a width of about 0.1-10 mm or preferably about 1-3 mm and a depth of about 0.05-3 mm and preferably about 0.5-2 mm.

Suckers used in the present invention may protrude out from the front and heel pad sections i.e. pointing out to the inside of the shoe with the aim of achieving grip and suction. The shape and orientation as to how the suckers extend out has been found to be crucial to obtain maximum grip and comfort for a user.

In one embodiment the outer side walls of the suckers may extend substantially vertically away from the flexible pad sections. The outer side walls of the suckers may compress into the flexible pad section to ensure comfort for a user.

In a further embodiment the outer side walls of the suckers may extend in a circular shape with the side walls themselves being substantially 'C'-shaped. The outer side walls of the suckers may compress into the flexible pad section to ensure comfort for a user.

Alternatively, the suckers may have circular shaped side walls wherein the outer surface of the side walls are sloped inwards towards the central part of the concave sucker. The sucker may therefore be formed from a main central area which is concave shaped and circular side walls with their outer walls sloping inwards.

The base of the side wall of the sucker may be wider than the top portion which has been found to be optimal to increase the efficiency of the suction/gripping action. The side wall may therefore be wider at the bottom and tapers in reduced width towards the top of the side wall of the sucker. The base of the side wall may be about double the width of the top of the side wall.

The thickness of the side wall may therefore vary from the bottom where it is at a maximum to a minimum at the top. This provides a highly flexible structure that has been found to provide maximum suction and gripping action but also improved comfort for a user. An advantage of this design is that the upper part of the side walls are not able to fold back against themselves and therefore form a superior suction and also provide greater comfort to a user.

Preferably, the outer surface of the side walls slope inwards at an angle of about 20-70 degrees or preferably about 30-70 degrees. This has been found to be a specific advantage in that with no undercuts provides improved suction and grip for a user.

The suckers as defined in the application and throughout the present application may have a diameter of about 0.2-2 cm and preferably about 0.5-1 cm. The maximum depth of the concave shape of the sucker may be determined by the thickness of the material but may have a maximum depth of about 0.05-5 mm and preferably about 0.5-2 mm. This determines the amount of suction action that may be achieved.

The circular outer side walls may be compressed into the flexible pad section to ensure comfort for a user.

The present invention also covers the method of construction of the suckers. During the method of manufacture a core plastic or metal insert is used to form the concave area in the middle of the sucker by being pressed into a flat rubber, rubber-like and/or plastics material. The core insert is fundamental to the formation of the suckers as the suckers are formed with no undercuts showing i.e. no 'flappy' parts. The specific technical advantage of forming these suckers in this manner is that the outer surface of the side walls can be shaped to slope inwards and have no undercuts and are therefore allowed to retract and flatten out easily under pressure when a person's foot applies pressure to the sucker.

The side walls of the suckers may also slop inwards towards to the central concave area of the sucker with a curved convex wall shape. This has been found to further improve the retraction and flattening of the side walls under pressure from a user's foot.

By having no undercuts also enables the wearer to put the sock on without catching the sole of the foot and also allows better comfort when being used as it eliminates a ridge edge on the sucker which might be felt by an athlete when applying pressure on the suckers.

On the rear face of the rubber pad sections which is the side which is attached to the sole of the sock, the rear surface of the suckers may form a convex orientation wherein there is an annular hollow portion extending around the convex portion. The annular hollow portion may be in direct contact with a user's bare foot and provides suction and grip.

The convex shape of the suckers may have a diameter of about 0.2-2 cm and preferably about 0.5-1 cm. The maximum depth of the convex shape is determined by the thickness of the material but may be about 0.05-5 mm and preferably about 0.5-2 mm. This determines the amount of suction action that may be achieved.

The front face of the rubber pad sections which is the portion which is next to and adjacent to the inside of the shoe has the suckers in the form of a concave orientations with side walls having protruding circular side walls extending around the concave portion. The side walls point inwards optionally with a concave shape and have no undercut.

The protruding circular side walls extending around the concave portion of the suckers may protrude out from raised island-like areas on the front and heel pad sections by about 0.02-2 mm or preferably about 0.05-0.5 mm.

There may also be a channel between the island-like areas which not only provides additional flexibility but also additional areas to create suction and gripping. The channels may have a width of about 0.1-10 mm or preferably about 1-3 mm and a depth of about 0.05-3 mm and preferably about 0.5-2 mm.

The sock of the present invention may also help to prevent overheating and blisters forming on a user. This effect occurs due to the improved ventilation of the sock.

As an alternative or in addition to the suckers there may also be a section and/or series of matrix webbing which may be made from silicone and/or rubber-like material.

The pads may also be located on the inside or outside of the sock.

The pads may be made from any suitable material such as rubber-like material that provides high friction to a user's foot and the inside surface of a shoe. For example, the rubber-like material may be made from silicone or silicone type material. This helps to prevent slipping and securely connects an athlete to their shoes.

The suckers in the present invention may therefore also be made from any suitable rubber, rubber-like and/or plastics membrane e.g. a silicone based material.

In particular embodiments there may be two pads on the underside of the sock with a first pad located at the front area of the sock and a second pad located at the heel in the rear of the sock. There may be a plurality of suckers (e.g. micro-suckers) on both sides of the pads. A similar arrangement of pads may also be located on the inside of the sock.

The pads may be inserted into an aperture in the sock.

Alternatively, the pads may be attached using adhesive and/or mechanical attachment such as sewing and/or stapling. The pads may therefore be connected to the sock via any suitable means such as sewing, gluing, hook and loop fastener etc.

The pads may also be replaced by a user for different sports to provide different levels of traction for different conditions (e.g. running in the rain) or retrofitted to renew and replace the pads.

The pads may therefore provide further traction for an athlete.

This means that in some embodiments a user's foot may contact the inside surface of the pads and the outer surface of the pads may contact the inside surface of a sports shoe e.g. a running shoe.

In the area of the sock on the underside such as between the pads there may be a series of perforations and/or apertures in the sock to improve ventilation and airflow. The air can therefore dissipate from the instep of the sock by the textile becoming taut allowing the apertures to enlarge or alternatively by channels which allow air to flow freely from specific areas on the sock or channelling through the whole sock. This has been found to improve ventilation.

The suckers on the pads may be small protrusions or alternatively indentations, or a combination thereof, which are capable of forming a sucking action to attach themselves to the inside surface of a shoe and/or to a user. As indicated the pads with the suckers may be on one of or both the inside and outside of the sock. This has been found to improve traction.

The suckers can be made of silicone or rubber or similar and formed into any shape to allow traction to take place. The suckers can comprise a flat, raised or indented profile.

The suckers may be added to the sock individually or a single sided pad or in a double sided pad and thereby fitted into a hole cut or an aperture in the sock. The suckers may come into contact with the internal surface of the shoe while the other side of the sucker will come into direct contact with the skin of the sole of the foot. There can be various means of applying the application of the suckers to the shoe and also to the skin. The suckers positioned at the ball of the foot and the heel of the foot they may also cover the whole of the underside at the base of the foot and ankle area.

In a further alternative the sock may comprise a spacer fabric/textile which the whole sock can be made from or applied to specific areas of the sock like the instep or the ankle area to the top of the sock.

The sock of the present invention may also provide an airflow system.

To assist with the airflow system there may be corrugations at the top of the sock. The corrugations facilitate the channelling of air and allows the skin of a user to be cooled by evaporation rather than wicking through capillary action.

From the ankle of the sock to the top of the sock air may therefore be able to vent by vertical channelling in the corrugations in the sock which will vent at the top of the sock. Alternatively, or in addition, wide apertures at the front of the sock may allow the air to move horizontally from front to back of the sock and then vent through channelling in the corrugations. The corrugations can be of any suitable size and shape and may extend throughout the whole length of the sock or from the ankle to the top of the sock.

The top of the sock may also comprise a web structure helping to create the corrugated effect which promotes and facilitates the airflow system. The corrugated effect may comprise a series of openings spread about 0.2 cm to 1 cm apart. The corrugations may extend away from the surface of a user by about 0.1 cm to about 1 cm to create the openings to allow the airflow system to operate.

The suckers in the present invention may be on only one side of the pads but preferably are on both sides to improve traction and grip when wearing the sock and thereby minimising movement, increasing comfort and performance.

The present invention also relates to a mesh which may be placed inside and/or outside of a sock. The mesh may be attached to the inside and/or outside of a sock. The mesh may be in the form of a grid-like structure. The mesh may be made from a rubber and/or plastics and/or silicone based material. The mesh may flex by expanding and contracting during use. The mesh may extend along the full length of the sock or may simply be at the front and/or heel of the sock. Along grid lines of the mesh there may be a series of suckers as previously defined. The suckers may be conical in shape and may be silicone/rubber based. The suckers may provide suction and improved grip for a user.

The present invention also relates to parallel strips of rubber and/or plastics based material on top of which are located a series of suckers. The parallel strips of material may be attached to the inside and/or outside of a sock. The parallel strips of rubber and/or plastics based material may be able to expand and contract during use i.e. stretch. It is preferred that the parallel strips of rubber and/or plastics based material may be aligned to run parallel to the length of the sock and toes. The parallel strips of rubber and/or plastics based material may be placed along the full length of the sock or may simply be at the front and/or heel of the sock.

BRIEF DESCRIPTION OF THE DRAWINGS

Embodiments of the present invention will now be described by, way example only, with reference to the following Figures wherein.

DETAILED DESCRIPTION

Figure 1:
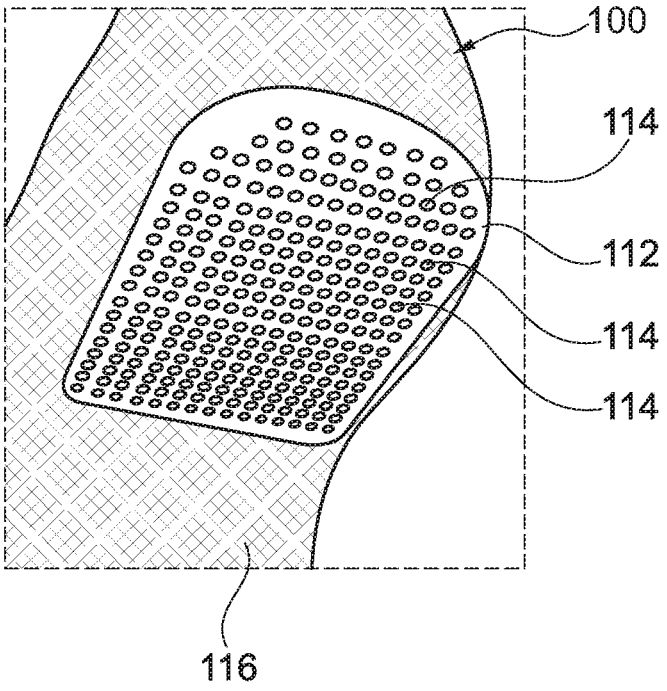
FIG. 1 is a representation of the underside of a sock according to an embodiment of the present invention.

FIG. 1 is an underside view of a sock 100 according to the present invention. As shown in FIG. 1, on the underside of the sock in the heel area there is a pad 112 with a plurality of suckers 114 (e.g. micro-suckers). The pad 112 is inserted into an aperture in the sock meaning that a user's foot will contact the other side of the pad 112. The suckers 114 are designed to increase traction and securely connect an athlete to their shoes and prevent any slippage occurring. This is extremely important in sprinting or other sports where sudden forces and/r changes in direction are exerted.

Figure 2:
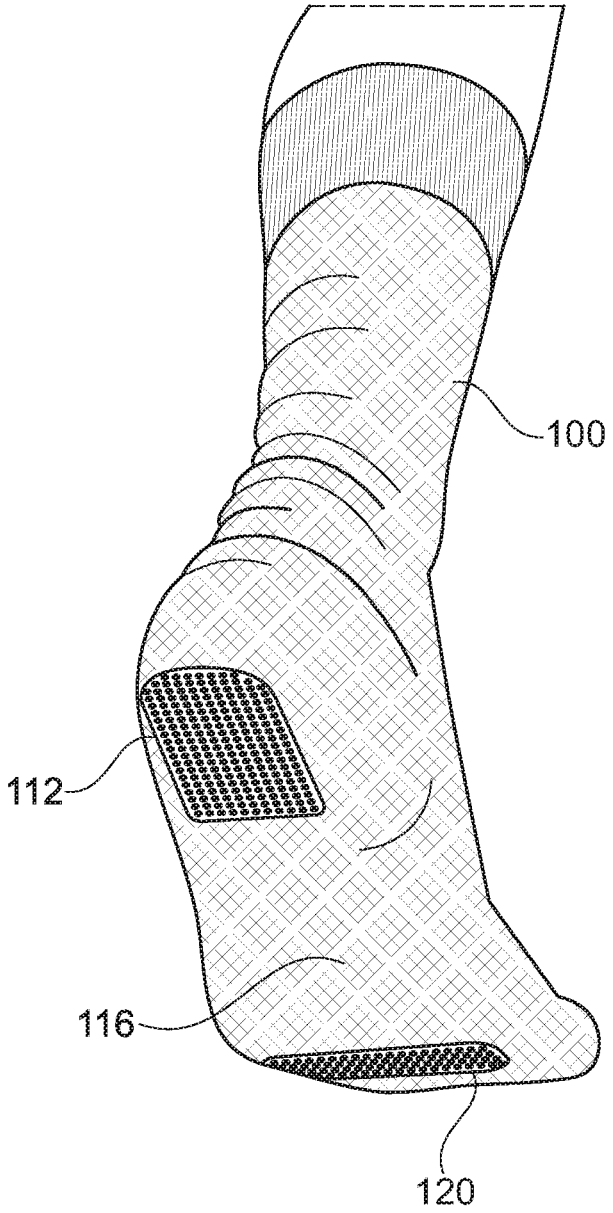
FIG. 2 is a further representation of the sock shown in FIG. 1 showing pads on the underside of the sock.

FIG. 2 is a further view of the sock 100. In addition to the pad 112 at the heel area of the sock 100, FIG. 2 shows that there is a pad 120 at the front of the sock 100. The front pad 120 provides further traction for an athlete. Similarly, to the heel pad 112, the front pad 120 is inserted into a second aperture in the sock 100. This means that a user's foot will contact the inside surface of the front pad 120 and the outer surface of the front pad 120 will contact the inside surface of a shoe.

In the area 116 of the sock 100 on the underside between the pads 112, 120 there is a series of perforations in the sock 100 to improve ventilation and airflow. The air can therefore dissipate from the instep of the sock 100 by the textile becoming taut allowing the apertures to enlarge or by channels which allow air to flow freely from specific areas on the sock 100 or channelling through the whole sock 100.

The pads 112, 120 are made from any suitable material such as a rubber, rubber-like and/or plastics material that provides high friction to a user's foot and the inside surface of a shoe. The pads 112, 120 may be made from a silicone type of material. This helps to prevent slipping and securely connects an athlete to their shoes.

The pads 112, 120 can be connected to the sock 100 via any suitable means such as sewing, gluing, hook and loop fastener etc. The pads 112, 120 may also be replaced by a user for different sports to provide different levels of traction for different conditions (e.g. running in the rain) or retrofitted to renew and replace the pads 112, 120.

The suckers on the pads 112, 120 may be small protrusions or alternatively indentations, or a combination thereof, which are capable of forming a sucking action to attach themselves to the inside surface of a shoe and/or to a user.

The suckers can be made of silicone, rubber or other similar material and formed in any shape so as to allow traction to take place. The suckers can have flat, raised or indented profile. The suckers can be added to the sock 100 individually or as a single sided pad or in a double sided pad and thereby fitted into a hole cut in the sock 100. The suckers will come into contact with the internal surface of the shoe while the other side of the sucker will come into direct contact with the skin of the sole of the foot. The suckers will be positioned at the ball of the foot and the heel of the foot. The suckers may also cover the whole of the underside at the base of the foot and/or ankle area.

In a further alternative the sock 100 may comprise spacer fabric/textile which the whole sock 100 can be made from or applied to specific areas of the sock 100 such as the instep or the ankle area to the top of the sock. The spacer fabric/textile can be used to increase ventilation.

Figure 3:
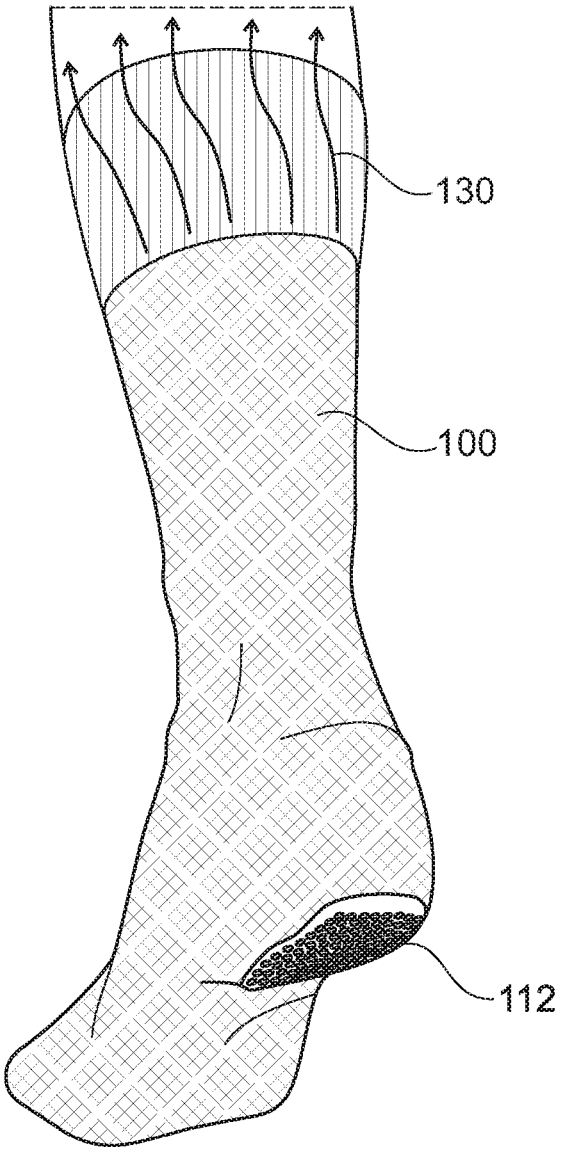
FIG. 3 is a further representation of the sock shown in FIGS. 1 and 2 showing the airflow system according to the present invention.

FIG. 3 shows the sock 100 being worn and an airflow system according to the present invention.

Figure 4:
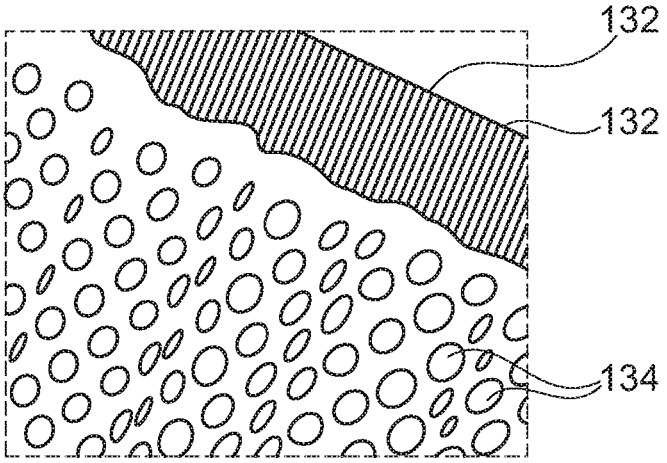
FIG. 4 is an enlarged view of an upper part of the sock shown in FIGS. 1 to 3.

FIG. 4 is an expanded view of the upper part of the sock 100 which shows the air ventilation system and that there are corrugations 132 at the top of the sock 100. The corrugations 132 facilitate the channelling of air and allows the skin of a user to be cooled by evaporation rather than wicking through capillary action. The arrows 130 at the top of the sock 100 show the air flow system.

From the ankle of the sock 100 to the top of the sock 100 the air will therefore be able to vent by vertical channelling along the corrugations 132. The air will vent at the top of the sock 100 or by wide apertures at the front of the sock 100 which allow the air to move horizontally from front to back of the sock 100 and then vent. The corrugations 132 can be of any suitable size.

FIG. 4 also shows that there is a web structure 134 at the top of the sock 100 helping to create the corrugated effect which promotes and facilitates the airflow system. The corrugated effect may comprise a series of openings spread about 0.2 cm to 1 cm apart. The corrugations may extend away from surface of a user by about 0.1 cm to about 1 cm to create the openings to allow the airflow system to operate.

Figure 5:
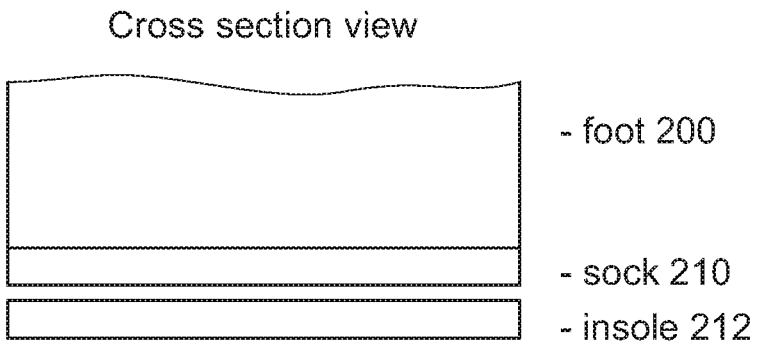
FIG. 5 is a cross-section view of a prior art sock.

FIG. 5 is a cross-section of a standard sock 210. A user's foot 200 is shown and the insole 212 of a shoe. During periods of activity standard socks 210 allow the foot of a user to move. This leads to lack of performance, discomfort and blisters.

Figure 6:
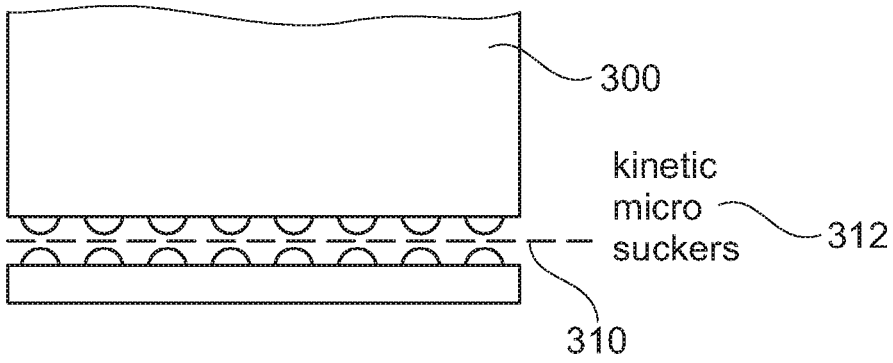
FIG. 6 is a cross-section of a sock according to a further embodiment of the present invention.

FIG. 6 is a view of a sock 310 of the present invention. The suckers 312 are shown on either side of the sock 310. The suckers 312 are found to dramatically increase traction and thereby minimising movement, increasing comfort and performance.

Figure 7:
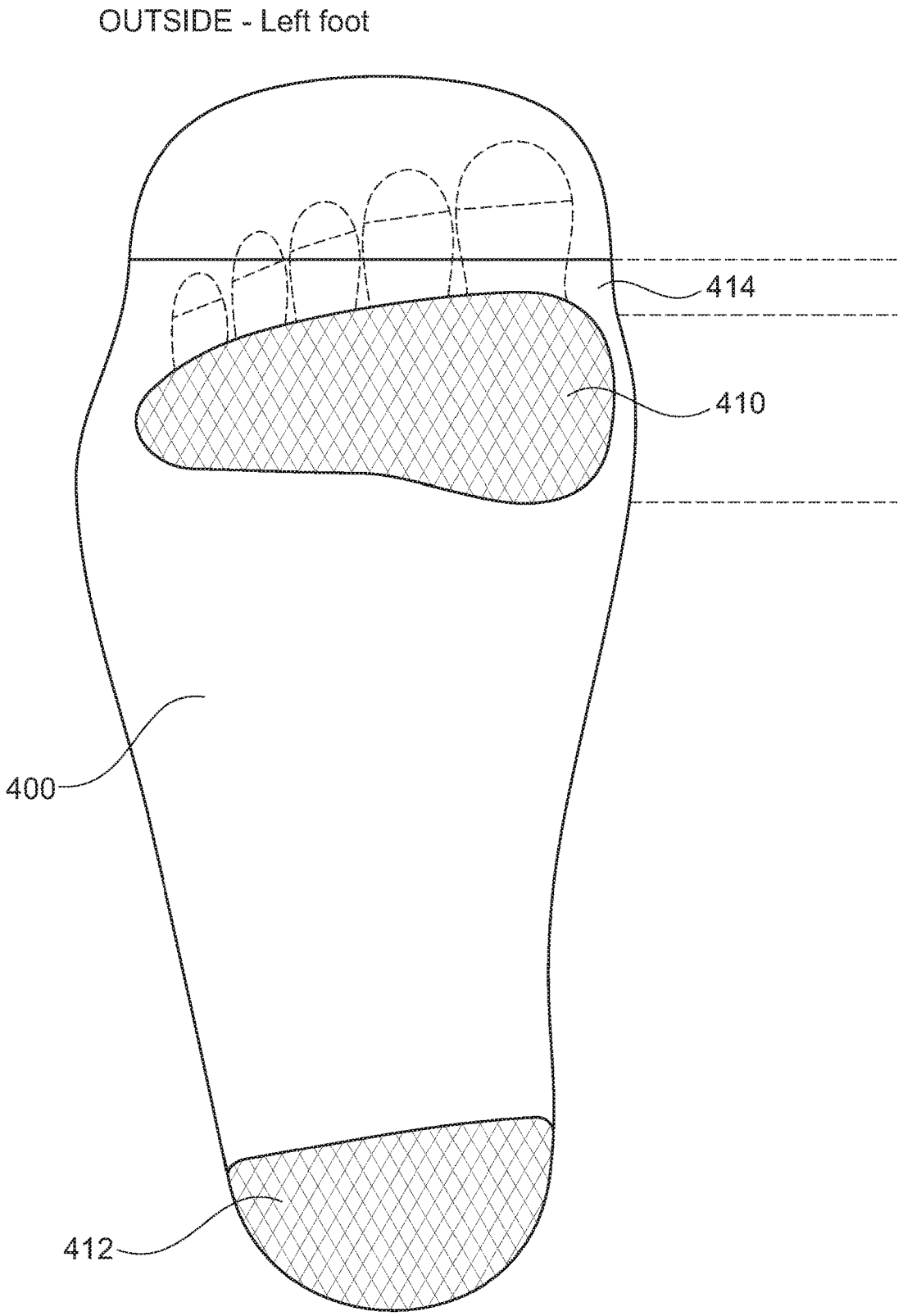
FIG. 7 is the outside of a sock according to a further embodiment of the present invention.

FIG. 7 is a view of a sock 400 according to the present invention. As shown in FIG. 7 at the front of the sock 400 there is a matrix webbing 410 with a gap area 414 in front of the toe area of the foot. The matrix webbing 410 may also comprise suckers if necessary. The webbing 410 is shaped so as to be larger in the big toe area and tapered towards the smaller toes. There is also a heel area 412 which also optionally extends up about 1-4 cm the heel area of the sock 400.

Figure 8:
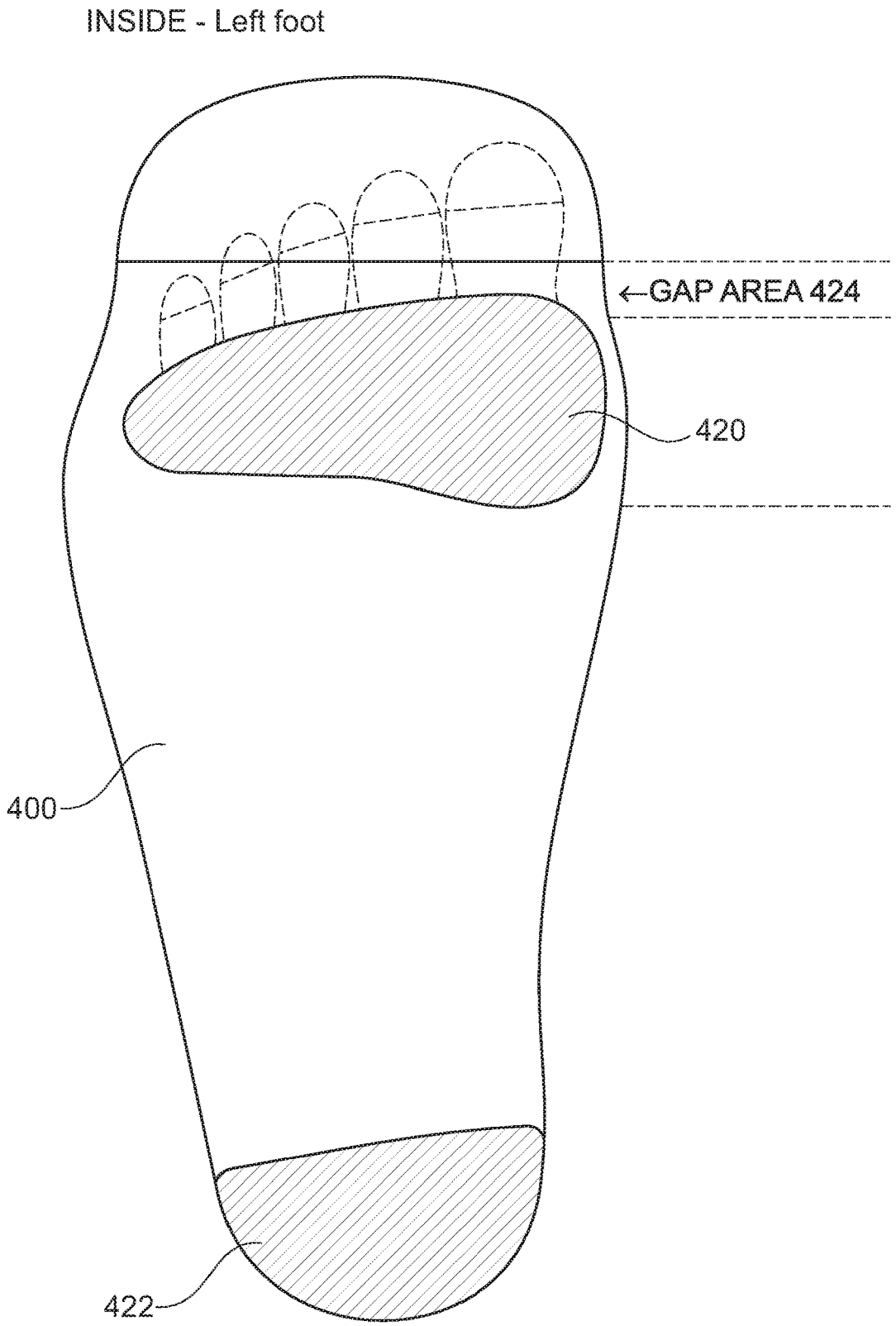
FIG. 8 is a view of the inside of the sock shown in FIG. 7.

FIG. 8 is a view of the inside of the sock 400. There is shown a silicone pad 420 at the front of the sock which is largest at the big toe area and tapers towards the smaller toe. At the heel area there is a further silicone pad 422 which extends up the back area of the sock 400 by about 1-4 cm.

Figure 9:
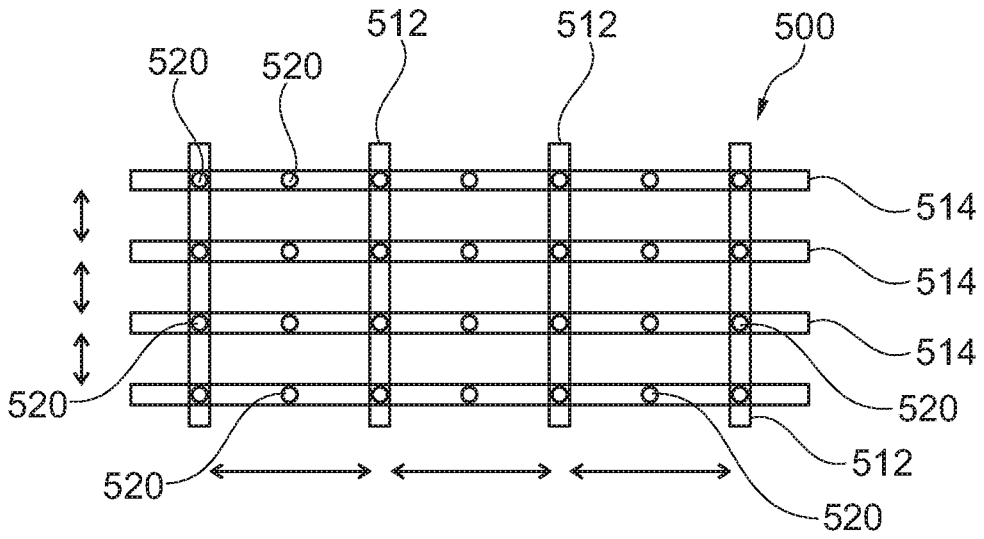
FIG. 9 is a view of a further embodiment of the present invention showing a mesh.
Figure 10:
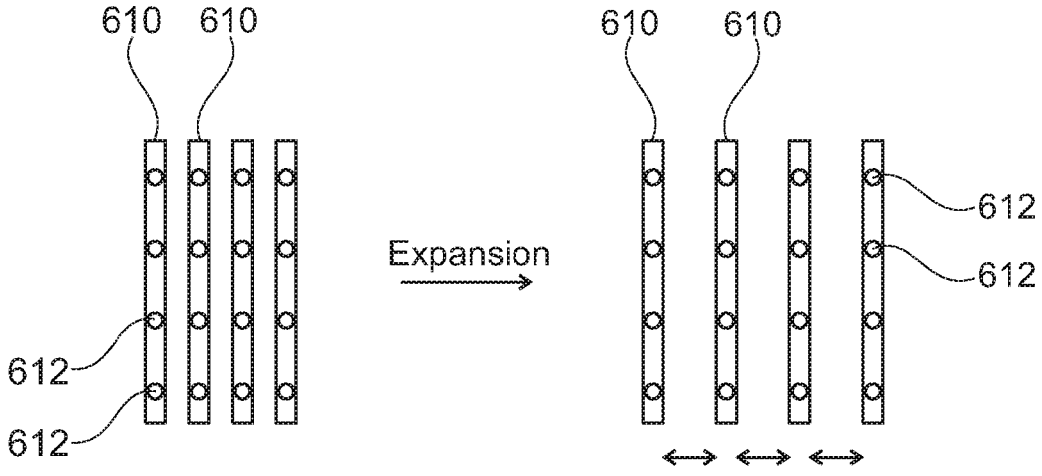
FIG. 10 is view of a further embodiment of the present invention showing strips of rubber which can be placed on a sock.

FIG. 9 is view of a mesh 500 which can be placed inside and/or outside of a sock. The mesh 500 as shown can be a grid-like structure. The mesh 500 can be made from a rubber and/or plastics based material. As shown by the arrows the mesh 500 can flex by expanding and contracting during use. The mesh 500 can extend along the full length of the sock or may simply be at the front and/or heel of the sock. Along grid lines 512, 514 of the mesh 500 there may be a series of suckers 520 as previously defined. The suckers 520 are conical in shape and are silicone/rubber based. The suckers 520 provide suction and improved grip for a user.

Figure 11:
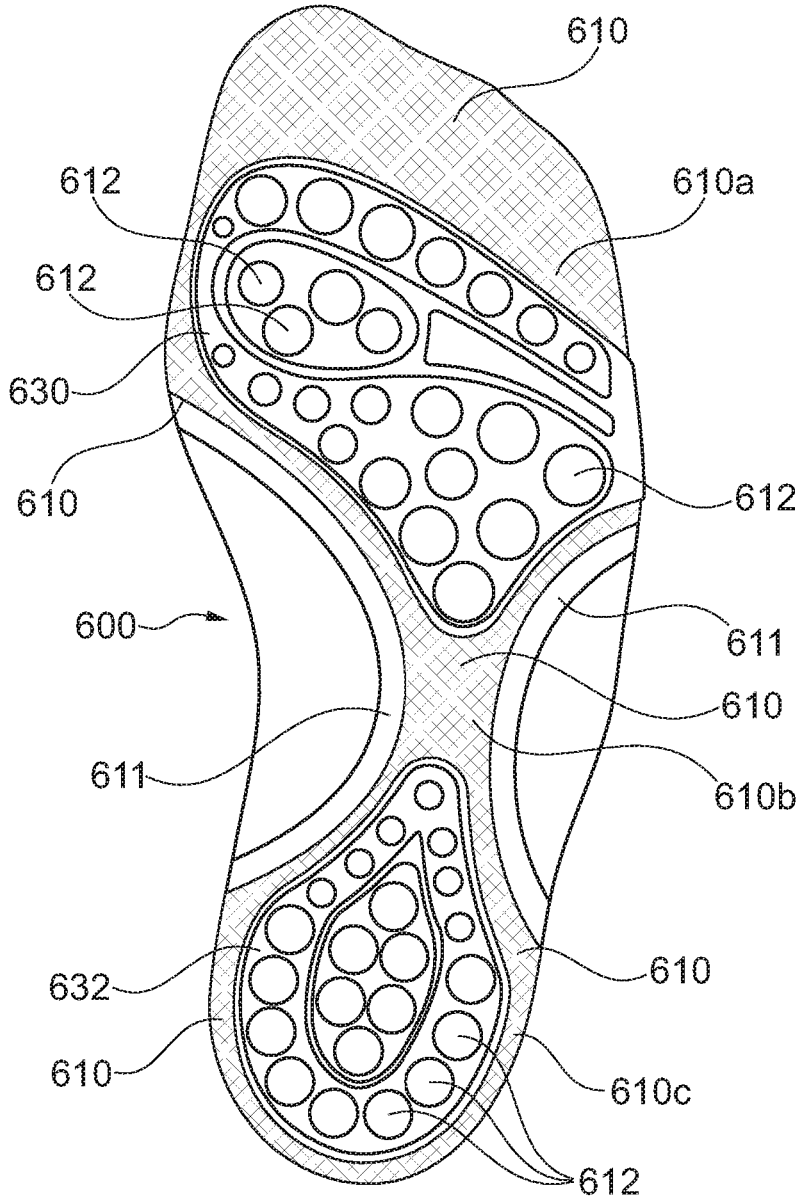
FIGS. 11 to 12*c* are views of a sock according to a further embodiment of the present invention.

FIG. 11 is a representation of a further embodiment of a sock 600 according to the present invention. FIG. 11 shows the underside of the sock 600. The main body 611 of the sock 600 is made from cotton/wool.

As shown there is a base rubber membrane 610 located on the bottom of the sock 600 which extends from the toe area to the heel area. The base rubber membrane 610 may cover the majority of the sole of the sock 600 and as shown may be in a 'figure 8' shape. The base rubber membrane 610 comprises a front foot portion 610*a*, a rear foot portion 610*c* (i.e. a heel portion) and a thin linking portion 610*b*. The base rubber membrane 610 is only an optional feature of the sock 600 and can be used where additional grip is required.

The base rubber membrane 610 may be a thin portion of flexible rubber, rubber-like and/or plastics material which has the function of increasing grip for a user at the bottom of the sock 600. The base rubber membrane 610 may be flat or may comprise a series of thin parallel rubber, rubber-like and/or plastics material strips in the form of small ridges running the length of the sock 600 i.e. from the toe area to the heel area.

The parallel strips of rubber, rubber-like or plastics material strips are able to expand and contract during use i.e. stretch and expand. It has been found that it is preferred for the rubber, rubber-like and/or plastics material strips are aligned to run parallel to the full length of the sole of the sock 600.

The parallel strips of rubber, rubber-like and/or plastics based material may therefore be placed along the full length of the sock or may simply be at a front and/or heel portion of the sock.

On the sole of the sock 600, and as shown in FIG. 11, there is a front rubber, rubber-like and/or plastics based pad section 630. At the heel of the sock 600, there is a second rubber, rubber-like and/or plastics based pad section 632. Both of the pad sections 630, 632 are made from a thin portion of flexible rubber, rubber-like and/or plastics material. The pad sections 630, 632 comprise a plurality of suckers 612.

The suckers 612 are preferably but not exclusively made from the same material as the material forming pad sections 630, 632. The suckers 612 may therefore be formed in a unitary manner with the pad sections 630, 632. The suckers 612 are described in more detail below. However, it should be appreciated that any form and pattern of suckers 612 may be used and for different sports they may be different preferred orientations and sizes of suckers 612.

Figure 12C:
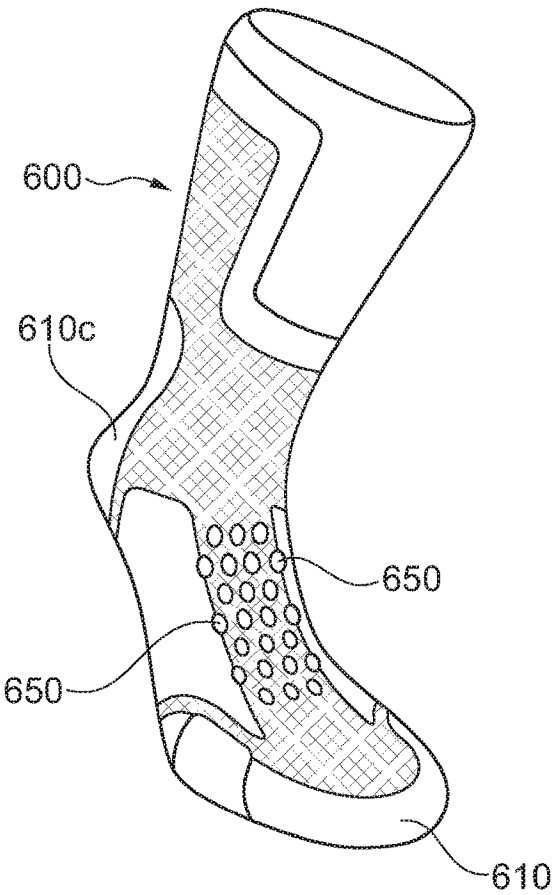
Figure 12B:
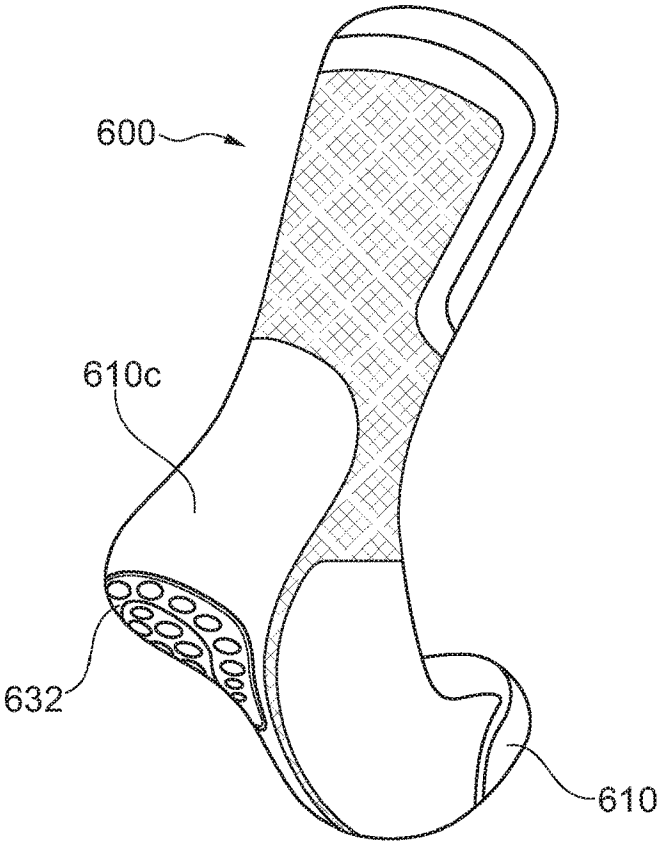
Figure 12A:
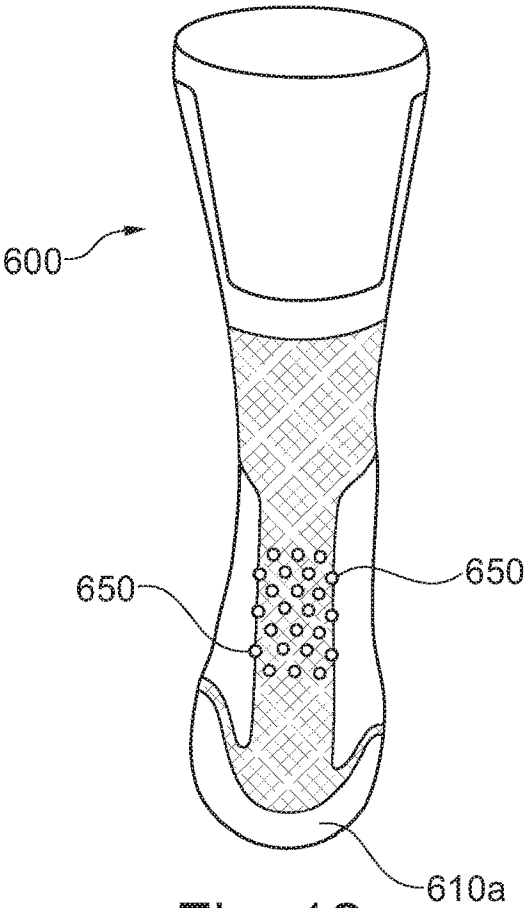

FIGS. 12*a*, 12*b*, 12*c* are different views of the sock 600 according to the present invention. As clearly shown in FIGS. 12*b* and 12*c*, at the heel portion of the sock 600, the rear portion 610*c* extends around the heel and up part of the back of the calf area of the leg. As described above, the rear portion 610*c* may be in the form of a thin portion of rubber, rubber like, and/or plastics material which may comprise a series of thin parallel rubber, rubber-like and/or plastics material strips which are used to improve grip during use.

FIGS. 12*a*, 12*b* and 12*c* also show that on the front upper area of the sock 600 there is a plurality of small rubber, rubber-like and/or plastics material inserts 650 which protrude slightly outwardly from the sock 600 and are also used to improve grip when the sock is placed within a sporting shoe.

As also shown in FIGS. 12*a*, 12*b* and 12*c* the front foot portion 610*a* of the base rubber membrane 610 extends partially up and around the toe area of the sock 600. This has been found to provide further improved grip for user when the sock is in a shoe.

Figure 13:
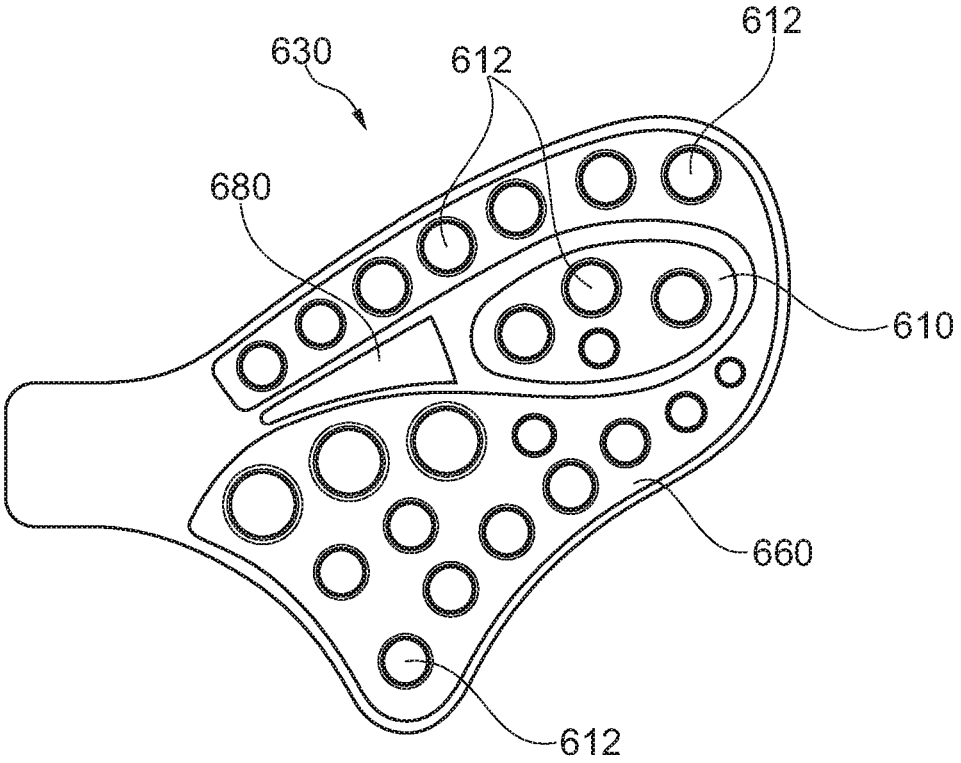
FIG. 13 is a view of the rubber pad on the bottom of the sole of the sock shown in FIGS. 11 to 12*c;*

FIG. 13 is a view of the front rubber pad section 630 onto which there is located a plurality of suckers 612. (This is for the left-foot). The suckers 612 are located on a series of protruding island-like areas 660, 670. There is also a further island area 680 which simply adds comfort for the user of the socks 600.

Figure 14:
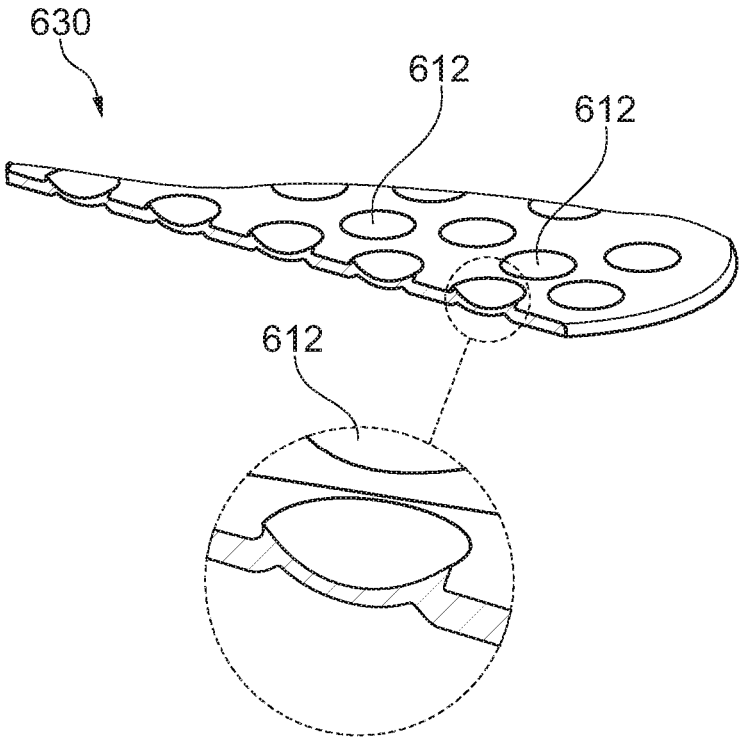
FIG. 14 shows a sectional view of the rubber pad shown in FIG. 13.

FIG. 14 shows an expanded sectional view showing that the suckers 612 (i.e. suctions cups) are integrated in a unitary form into the pad surface of the front pad section 630.

Figure 15:
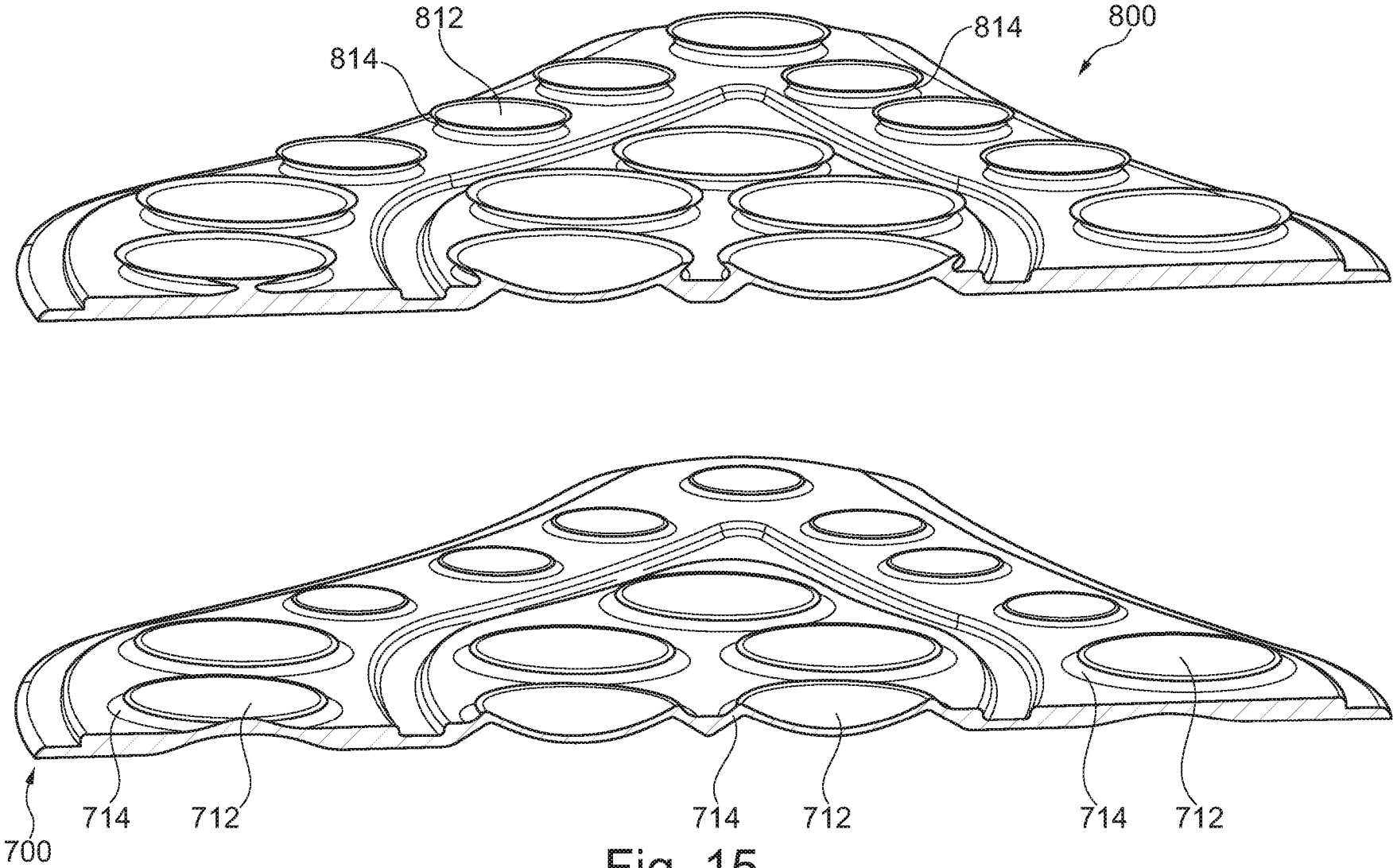
FIG. 15 shows two different embodiments for rubber pad according to further embodiments of the present invention.

FIG. 15 represents two further rubber membrane pad sections according to the present invention. The pad section 800 has been found to be less preferred as the suckers 812 therein have side walls in the form of a 'C'-shape turned on their side. The upper lip portion of these 'C'-shape side walls have been found to have the slight tendency to turn over on themselves when pressure is applied by a user during use. This therefore provides reduced suction and also potential discomfort to the user of the sock due to their being a non-flat surface.

The base rubber membrane portion 700 has been found to be much preferred. As shown the suckers 712 therein have circular shaped side walls 714 which are sloped inwards towards the central part of the sucker 712. The sucker 712 is therefore formed from a main area which is concave shaped and circular side walls 714 which slope inwards. The base of the side wall 712 is wider than the top portion which has been found to be optimal to increase the efficiency of the suction/gripping action. The side wall is therefore wider at the bottom and tapers in reduced width towards the top of the side wall 714. The thickness of the side wall 714 therefore varies from the bottom where it is at a maximum to a minimum at the top. This provides a highly flexible structure that has been found to provide maximum suction and gripping action but also improved comfort for a user.

An advantage of this design is that the upper part of the side walls 714 are not able to fold back against themselves and therefore form a superior suction and also provide greater comfort to a user. Preferably, the side walls slope in at an angle of about 20-70 degrees or preferably about 30-70 degrees.

The suckers 712 as defined in the application and throughout the present application may have a diameter of about 0.2-2 cm and preferably about 0.5-1 cm. The maximum depth of the concave shape is determined by the thickness of the material but may be about 0.05-4 mm and preferably about 0.5-2 mm. This determines the amount of suction action that may be achieved.

FIG. 15 also shows that suckers 712 are located on raised island-like areas 720, 732. Between the island areas 720 there are channels 734 which not only provide additional flexibility but also additional areas to create suction and gripping. The channel 734 may have a width of about 0.1-10 mm or preferably about 1-3 mm and a depth of about 0.05-3 mm and preferably about 0.5-2 mm.

Figure 16:
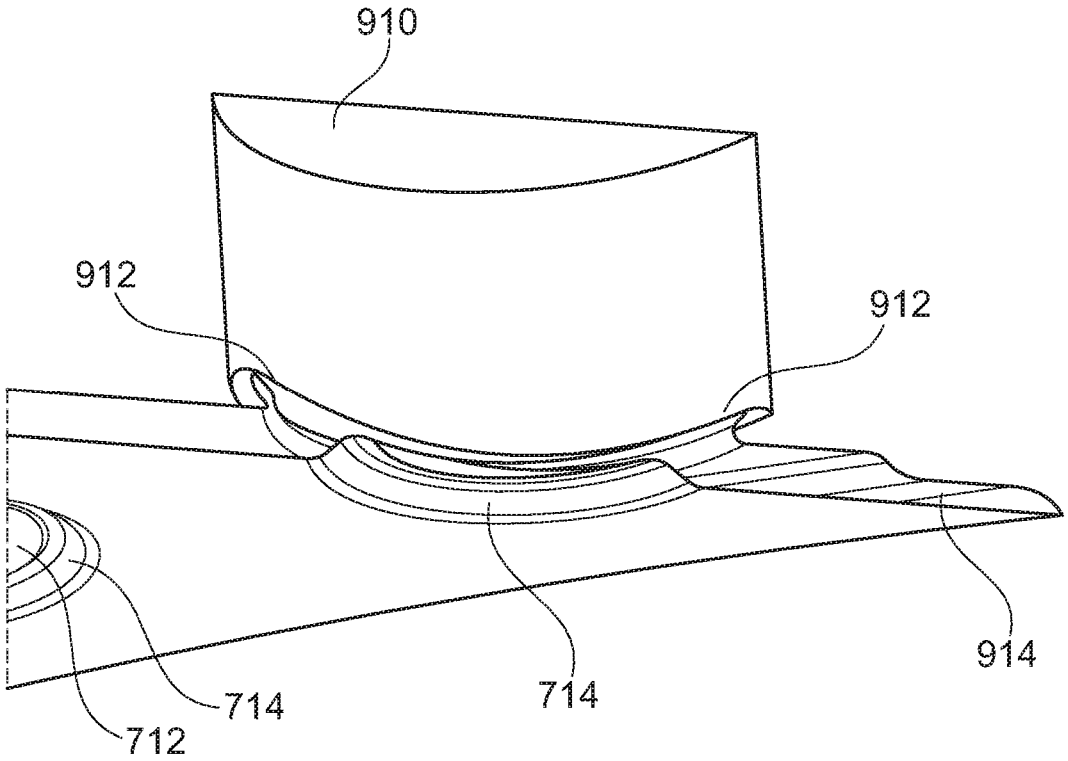
FIG. 16 shows a method of constructing the rubbers pads according to a further embodiment of the present invention.

FIG. 16 shows the method of construction of the suckers 712 shown in FIG. 15. During the method of manufacture a core insert 910 is used to form the concave area in the middle of the sucker 712. The core insert 910 is fundamental to the formation of the suckers 712 as the suckers 712 are formed with no undercuts showing. The specific technical advantage of forming these suckers as shown in FIG. 16 is that the side walls 714 as shown in FIG. 15 slope inwards and have no undercuts and are therefore allowed to retract and flatten out easily under pressure when a person's foot applies pressure to the sucker 712. Bu having no undercuts also enables the wearer to put the sock on without catching the sole of the foot and also allows better comfort when being used as it eliminates a ridge edge of the sucker which might be felt by an athlete when applying pressure on the suckers 712.

Figure 17:
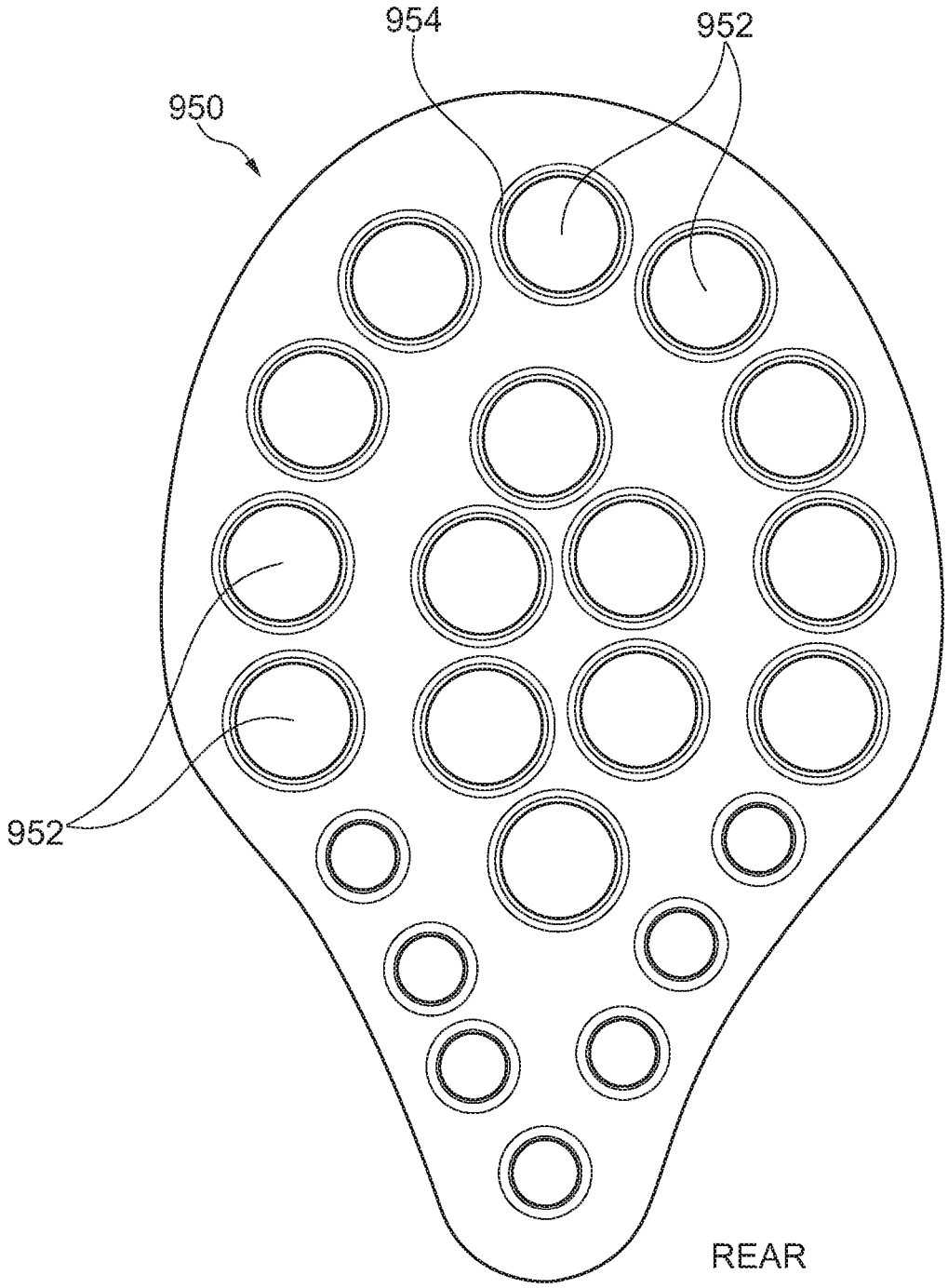
FIGS. 17 and 18 show a front and rear view of a rubber pad according to a further embodiment of the present invention.
Figure 18:
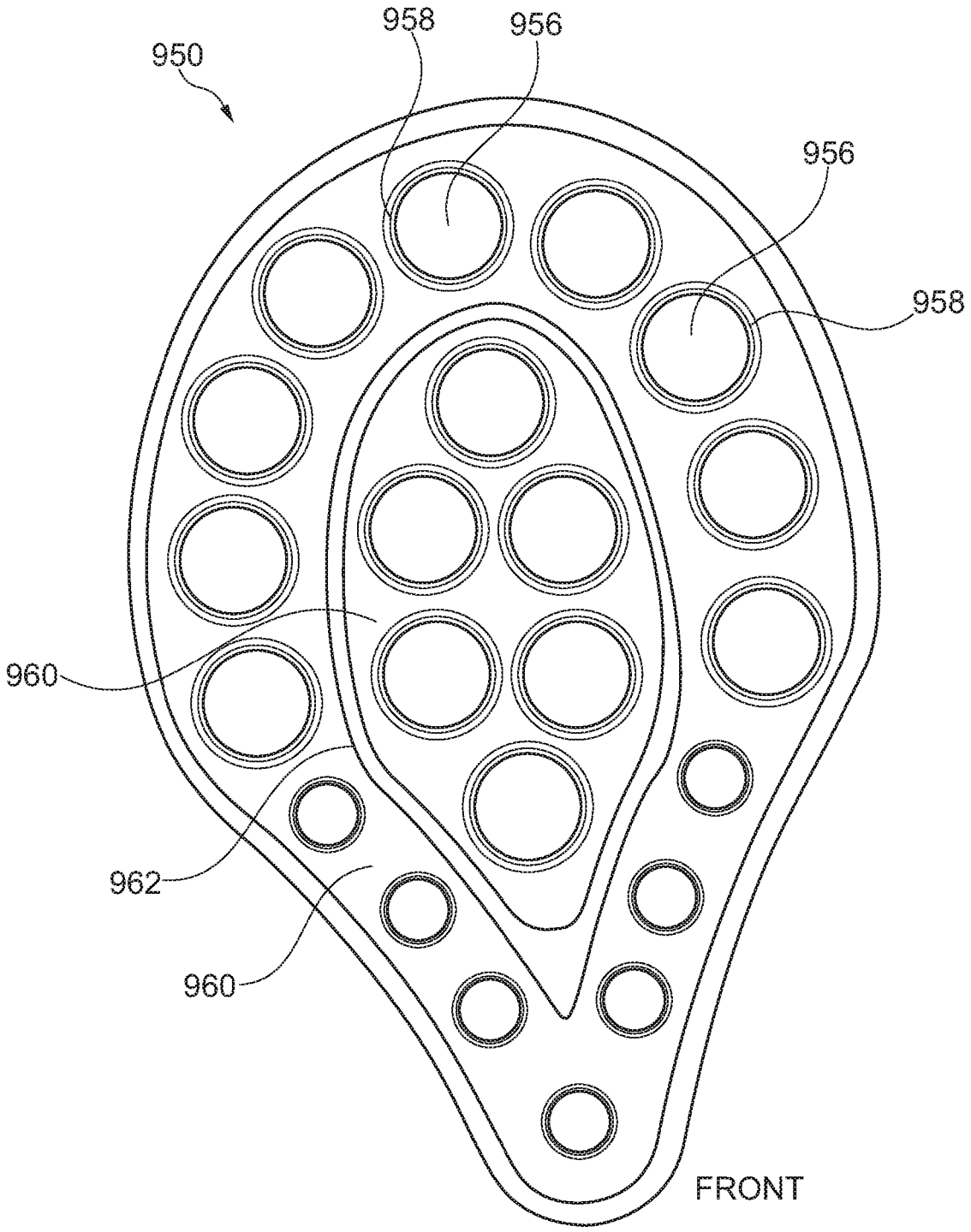

FIGS. 17 and 18 show a further base rubber pad section 950 according to the present invention. FIG. 17 is the rear surface of the rubber pad section 950 and this is therefore the side which is attached to the main part of the sock. As can be seen in FIG. 17 there is a plurality of suckers 952. On the rear surface, the suckers 952 form a convex orientation wherein there is an annular hollow portion 950 extending around the concave portion. The suckers 952 may have a diameter of about 0.2-2 cm and preferably about 0.5-1 cm. The maximum depth of the convex shape is determined by the thickness of the material but may be about 0.05-3 mm and preferably about 0.5-2 mm. This determines the amount of suction action that may be achieved.

FIG. 18 is the front of the rubber pad section 950 and is therefore the portion which is next and adjacent to the inside of the shoe. As shown the suckers 952 here are in the form of a concave 956 orientation with side walls 956 orientation with protruding circular side walls 958 extending around the concave portion 956. As previously described, the side walls 958 point inwards and have no undercut. Preferably, the side walls slope in at an angle of about 20-70 degrees or preferably about 30-70 degrees. This has been found to be a specific advantage in that with no undercuts provides and improves suction and grip for a user.

The protruding circular side walls 958 extending around the concave portion 956 protrude out from raised island-like areas 960 by about 0.02-0.4 or preferably about 0.05-0.2 mm. There is also shown a channel 962 between the island-like areas 960 which not only provides additional flexibility but also additional areas to create suction and gripping. The channel 962 may have a width of about 0.1-10 mm or preferably about 1-3 mm and a depth of about 0.05-3 mm and preferably about 0.5-2 mm.

Figure 19:
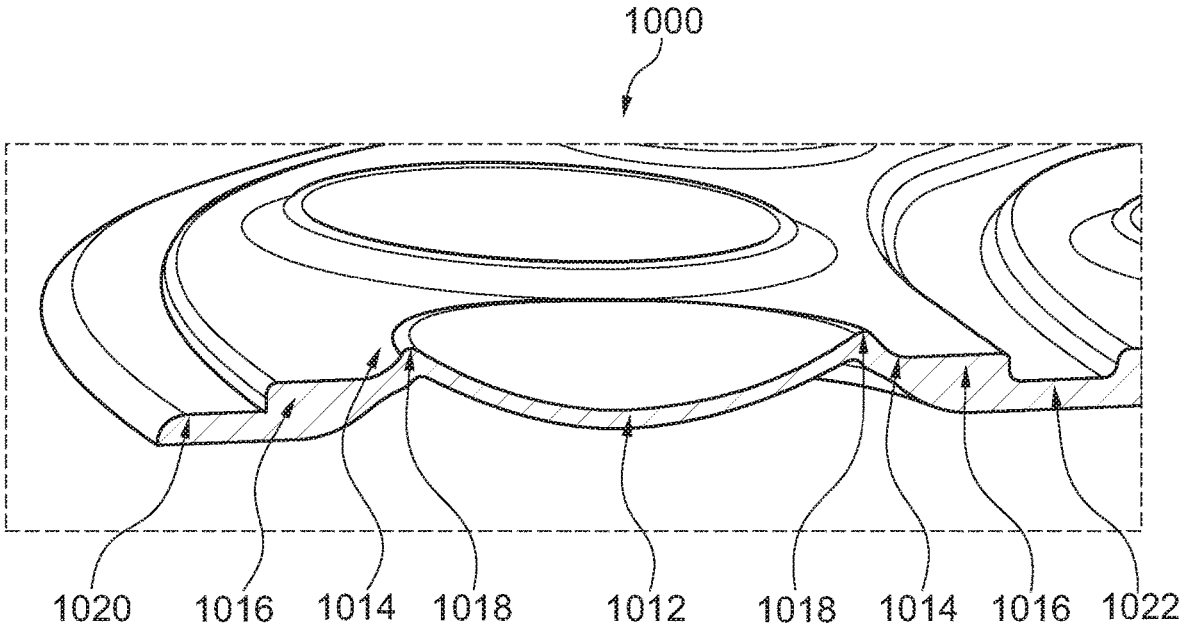
FIG. 19 is a sectional view of a further embodiment of the present invention showing an enlarged view of suckers.

FIG. 19 shows a further pad section 1000. The pad section is made from any suitable rubber, rubber-like and/or plastics material e.g. a silicone based material. As shown on the pad section 1000 there is a concave sucker 1012 with a side wall pointing inwards. The sucker 1012 is located on a raised island 1016. There are also shown recessed channel regions 1020, 1022. The top 1018 of the side walls 1014 is flat to ensure comfort for a user. The upper surface of the concave dome 1012 is smooth with no undercuts on the side walls 1014 which allows the whole pad section to be evenly compressed under pressure.

Figure 20:
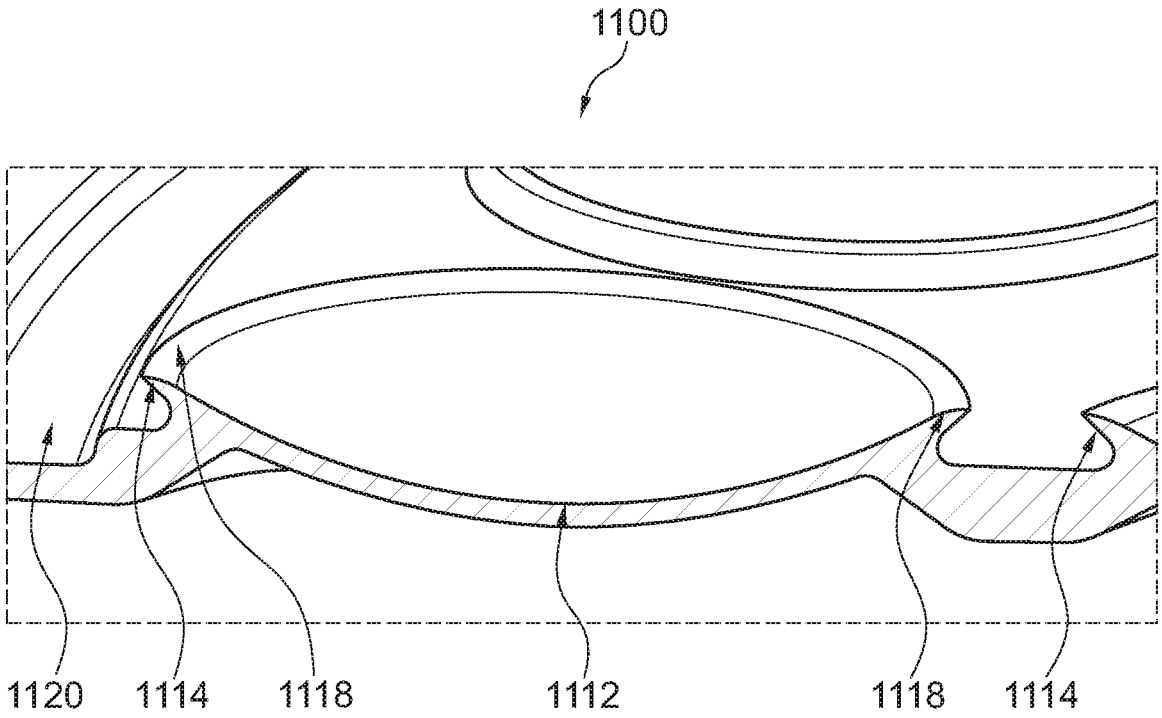
FIG. 20 is a sectional view of a yet further embodiment of the present invention showing an enlarged view of suckers.

FIG. 20 shows a further pad section 1100. The pad section is made from any suitable rubber, rubber-like and/or plastics material e.g. a silicone based material. As shown on the pad section 1100 there is a concave sucker 1112. The sucker 1112 has a side wall 1114 which has been found to be less preferred due to the undercut. The top 1118 of the side wall 1114 is also not flat. It is important to note that due to the undercut in the side wall which extends outwards away from the central part of the concave sucker 1112 the pas section 1100 when depressed has an uneven cross-sectional thickness and therefore does not provide maximum comfort to a user.

Whilst specific embodiments of the invention have been described above, it will be appreciated that departures from the described embodiments may still fall within the scope of the invention. For example, any suitable type of suckers may be used.

The invention claimed is:

1. A sock comprising:

at least one flexible pad section located on the underside of the sock;

the at least one flexible pad section having a rear face which is attached to the sock and an outwardly facing front face;

a plurality of suckers located on the at least one flexible pad section;

on the front face of the at least one flexible pad section, each of the plurality of suckers form a concave shape, each of the plurality of suckers capable of creating a suction action when depressed from the rear face; and each of the plurality of suckers has a circular shaped side wall, wherein an outer surface of the side wall is sloped inwards towards a central part of the sucker, the base of the side wall is wider than the top portion;

wherein the plurality of suckers are configured to attach a person's foot to the inside of a shoe during use.

2. The sock according to claim 1, wherein the base rubber, rubber-like and/or plastics membrane covers the majority or all of the outer sole of the sock, and wherein the base rubber, rubber-like and/or plastics membrane is flexible and resiliently deformable.

3. The sock according to claim 1, wherein the base rubber, rubber-like and/or plastics membrane comprise a front foot portion, a rear foot portion (i.e. a heel portion) and a thin linking portion, and wherein the base rubber, rubber-like and/or plastics membrane is flat.

4. The sock according to claim 1, wherein the base rubber, rubber-like and/or plastics membrane comprises a series of thin parallel rubber, rubber-like and/or plastics material strips in the form of small ridges running the length of the sole of the sock i.e. from the toe area to the heel area, wherein on the underside of the sock there is a front rubber, rubber-like and/or plastics based pad section located toward the front of the foot, and optionally wherein there are 2-50 suckers on the front pad section or 10-30 suckers which are located substantially evenly over the front pad section, and wherein the suckers are of all the same size and shape or there is a variety of shapes and sizes.

5. The sock according to claim 1, wherein on the underside of the sock at the heel of the sock, there is a second rubber, rubber-like and/or plastics based heel pad section, and wherein there are 2-50 suckers on the heel pad section or 10-30 suckers which are located substantially evenly over the heel pad section, and wherein the suckers are of all the same size and shape or there is a variety of shapes and sizes and, wherein the front and heel pad sections are made from a thin portion of flexible rubber, rubber-like and/or plastics material which are flexible and resiliently deformable under pressure.

6. The sock according to claim 1, wherein the pad sections have a plurality of suckers integrated into the pad sections and the suckers are flexible and resiliently deformable under pressure.

7. The sock according to claim 1, wherein the pad sections are attached directly to the sock, or to a base rubber, rubber-like and/or plastics membrane located on the bottom of the sock which extends from the toe area to the heel area.

8. The sock according to claim 1, wherein the suckers are made from the same material as the material forming front and heel pad sections.

9. The sock according to claim 1, wherein at the heel portion of the sock, a rear portion of a base rubber, rubber-like and/or plastics membrane extends around the heel and up part of the back of the achilles area of the leg.

10. The sock according to claim 1, wherein at the front foot portion of the sock, a rubber rubber-like and/or plastics membrane extends partially up and around the toe area of the sock.

11. The sock according to claim 1, wherein the suckers are located on one or a plurality of protruding raised island-like areas on front and heel pad sections located on the underside of the sock, and wherein between the island areas on the front and heel pad sections there are channels which not only provide additional flexibility but also additional areas to create suction and gripping, and wherein the channels have a width of 0.1-10 mm or 1-3 mm and have a depth of 0.05-3 mm or 0.5-2 mm, and wherein the suckers protrude out from the front and heel pad sections i.e. pointing out to the inside of the shoe with the aim of achieving grip and suction.

12. The sock according to claim 1, wherein the suckers form a concave shape to the inside surface of a shoe and wherein outer side walls of the suckers extend in a circular shape with the side walls themselves being substantially 'C'-shaped.

13. The sock according to claim 1, wherein the side wall is wider at the bottom and tapers in reduced width towards the top of the side wall of the sucker, wherein the base of the side wall is about double the width of the top of the side wall, and wherein an outer surface of the side walls slope inwards at an angle of 20-70 degrees or 30-70 degrees.

14. The sock according to claim 1, wherein the suckers have a diameter of 0.2-2 cm or 0.5-1 cm and the maximum depth of the concave shape of the sucker is 0.05-5 mm or 0.5-2 mm, and wherein the side walls of the suckers slop inwards towards to the central concave area of the sucker with a curved convex wall shape.

15. The sock according to claim 1, wherein on the rear face of the pad sections which is the side which is attached to the sole of the sock, the rear surface of the suckers form a convex orientation wherein there is an annular hollow portion extending around the convex portion and wherein the portion of the sock in direct contact with the annular hollow portion is configured to be in direct contact with a user's bare foot, and provides suction and grip, and wherein the convex shape of the suckers have a diameter of 0.2-2 cm or 0.5-1 cm and the maximum depth of the convex shape is 0.05-5 mm or 0.5-2 mm.

16. A method of forming the at least one flexible pad section located on the underside of the sock according to claim 1, wherein the method includes using a core plastic or metal insert to form the concave area in the middle of the sucker by being pressed under elevated temperature conditions into a flat rubber, rubber-like and/or plastics material.

17. A sock comprising:

a base membrane on an underside of the sock, the base membrane extending from a toe area to a heel area, and comprising at least one of a rubber, rubber-like material, or a plastic;

a flexible pad having a rear face attached to the base membrane, and an outwardly facing front face; and a plurality of concave shaped suckers located on the flexible pad section, each of the plurality of suckers comprising:

a flexible, circular shaped side wall comprising an outer surface on the same side as the front face, the outer surface having a concave shape, a circular top portion encircling the outer surface, a circular base portion encircling the top portion and in contact with the flexible pad section, wherein the base portion has a wider diameter than the top portion, wherein the top portion is higher than the base portion, and wherein the outer surface slopes from the top portion to a center of the sucker, wherein each of the plurality of suckers is flexible and resiliently deformable under pressure.

18. The sock of claim 17, wherein the flexible pad section and the plurality of suckers are made from the same material, and wherein the base membrane extends around the heel portion and the achilles area of the sock.

19. The sock of claim 17, wherein the plurality of suckers comprises a first group of suckers and a second group of suckers, wherein each of the first group of suckers and the second group of suckers is located on a raised surface, and wherein a channel separates the first group of suckers from the second group of suckers.

20. A method for forming a flexible pad, the method comprising:

pressing a core plastic or metal insert on to a middle of a sucker on a flexible pad, wherein at least one of the core plastic of metal insert or the flexible pad is at an elevated temperature; and forming a concave shape in the middle of the sucker, wherein the flexible pad comprises at least one of rubber, rubber-like material or plastic material, wherein, when formed by pressing the core plastic or metal insert, the sucker is shaped to comprise:

a circular shaped side wall comprising an outer surface having a concave shape, a circular top portion encircling the outer surface, a circular base portion encircling the top portion and in contact with the flexible pad section, wherein the base portion has a wider diameter than the top portion, wherein the top portion is higher than the base portion, and wherein the outer surface slopes from the top portion to a center of the sucker.

* * * * *